US007316334B1

(12) United States Patent
Brody

(10) Patent No.: US 7,316,334 B1
(45) Date of Patent: Jan. 8, 2008

(54) SPRAY CAN HOLDING AND ACTUATING DEVICE

(75) Inventor: Harvey Brody, Costa Mesa, CA (US)

(73) Assignee: Delshar Industries, Inc., Santa Ana, CA (US)

( * ) Notice: Subject to any disclaimer, the term of this patent is extended or adjusted under 35 U.S.C. 154(b) by 0 days.

(21) Appl. No.: 11/539,088

(22) Filed: Oct. 5, 2006

Related U.S. Application Data

(62) Division of application No. 11/273,523, filed on Nov. 14, 2005, now Pat. No. 7,121,435, which is a division of application No. 10/154,545, filed on May 24, 2002, now Pat. No. 6,981,622.

(51) Int. Cl.
*B65D 83/00* (2006.01)

(52) U.S. Cl. ..... 222/402.15; 222/153.09

(58) Field of Classification Search ..... 222/402.15, 222/402.11, 402.12, 402.13, 402.14, 472–475, 222/182, 153.09
See application file for complete search history.

(56) References Cited

U.S. PATENT DOCUMENTS

| | | | |
|---|---|---|---|
| 679,247 | A | 7/1901 | Whiting |
| 2,530,583 | A | 11/1950 | Nurkiewicz |
| 2,877,934 | A | 3/1959 | Wallace |
| 2,960,260 | A | 11/1960 | Kutik |
| 3,169,672 | A | 2/1965 | Softer et al. |
| 3,172,582 | A | 3/1965 | Belpedio |

(Continued)

FOREIGN PATENT DOCUMENTS

| | | |
|---|---|---|
| GB | 1 163 978 | 9/1969 |

(Continued)

*Primary Examiner*—Frederick C. Nicolas
(74) *Attorney, Agent, or Firm*—Klein, O'Neill & Singh, LLP; Howard J. Klein

(57) ABSTRACT

A spray can holding and actuation device comprises a rim engagement element and a locking mechanism for compressing the rim engagement element against the rim surrounding the push-button valve on the can. The rim engagement element includes a compressible collar that is joined to a shroud that depends downwardly from a front portion of the device. The collar is dimensioned to fit around the rim, and it has a pair of opposed ends separated by a gap. In one embodiment, the locking mechanism includes a locking element that is attachable to the opposed collar ends when the ends are urged together to compress the collar against the rim. In another embodiment, the locking mechanism includes a latch that is pivotably attached to one of the collar ends and that is pivotable to a position in which it engages the other collar end and rim, whereby the collar ends are urged together to compress the collar against the rim. In still another embodiment, the shroud has a pair of opposed side surfaces, each of which is formed with an arcuate groove. A camming surface is formed in each of the grooves. The locking mechanism includes a latch that is pivotably attached to the rear surface of the shroud, and that has a pair of opposed arms, each of which terminates in a finger that rides in one of the grooves. The latch is pivotable between a first position in which the fingers are out of engagement with the camming surfaces, and a second position in which the fingers engage the camming surfaces. When the fingers engage the camming surfaces, the collar is compressed against the rim.

2 Claims, 5 Drawing Sheets

U.S. PATENT DOCUMENTS

| | | | | |
|---|---|---|---|---|
| 3,189,232 | A | 6/1965 | Joffe | |
| 3,506,159 | A | 4/1970 | Muller et al. | |
| 3,622,053 | A | 11/1971 | Ryden | |
| 3,865,283 | A | 2/1975 | Hayes | |
| 3,937,368 | A | 2/1976 | Hoagland | |
| 4,089,440 | A | 5/1978 | Lee | |
| 4,401,240 | A | 8/1983 | Brack | |
| 4,432,474 | A | 2/1984 | Hutchinson et al. | |
| 4,442,955 | A | 4/1984 | Bush | |
| 4,449,647 | A | 5/1984 | Reed et al. | |
| 4,505,335 | A | 3/1985 | Hayba | |
| 4,805,812 | A | 2/1989 | Brody | |
| 5,086,954 | A | 2/1992 | Brody | |
| 5,323,937 | A | 6/1994 | Brody | |
| 5,819,985 | A | 10/1998 | Brody | |
| 6,364,177 | B1 | 4/2002 | Taylor | |
| 6,981,622 | B2 * | 1/2006 | Brody | 222/402.15 |
| 7,121,435 | B2 * | 10/2006 | Brody | 222/402.15 |
| 7,216,784 | B2 * | 5/2007 | Brody | 222/402.15 |

FOREIGN PATENT DOCUMENTS

| | | |
|---|---|---|
| GB | 1 343 881 | 1/1974 |
| GB | 1 487 719 | 3/1976 |
| GB | 2 038 952 A | 12/1978 |
| GB | 2 001 706 A | 2/1979 |

* cited by examiner

FIG. 1
PRIOR ART
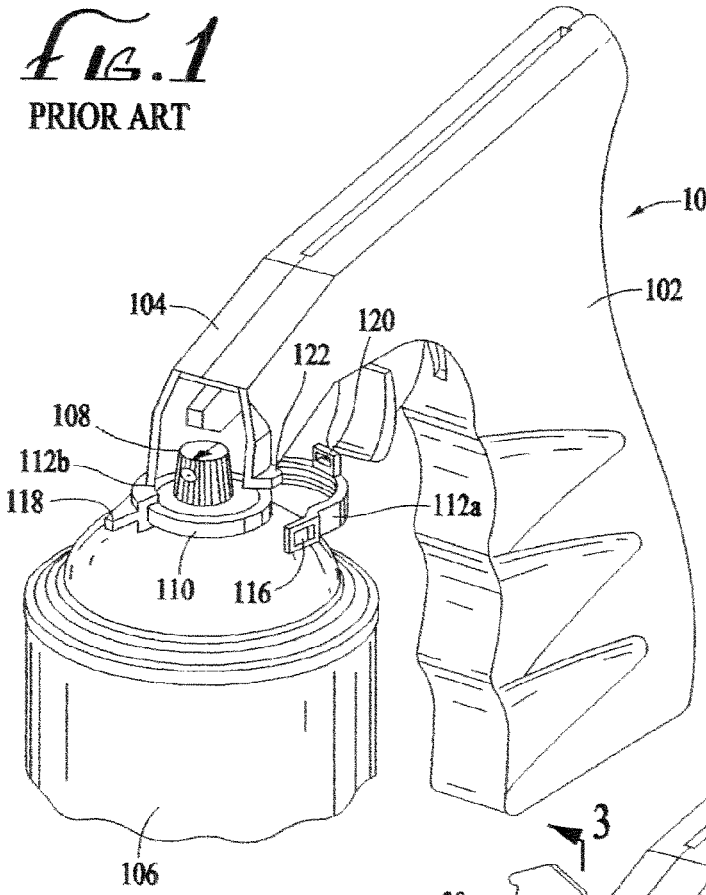
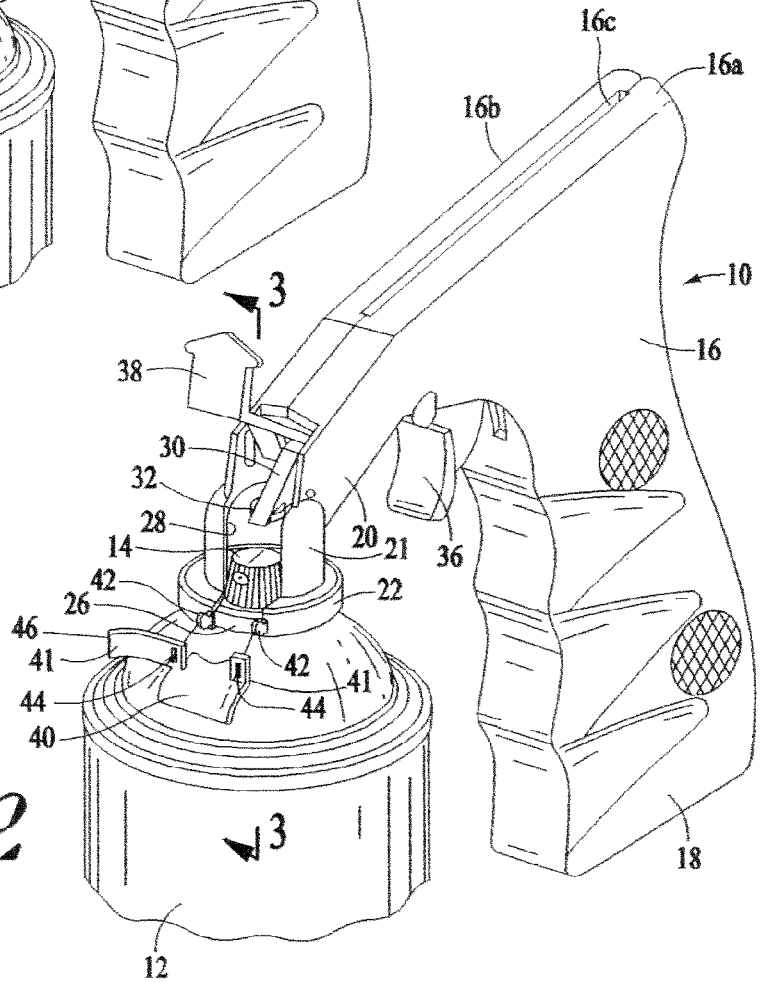
FIG. 2

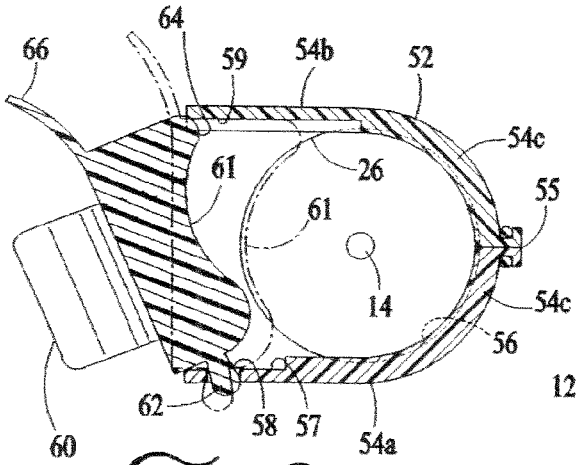
FIG. 8
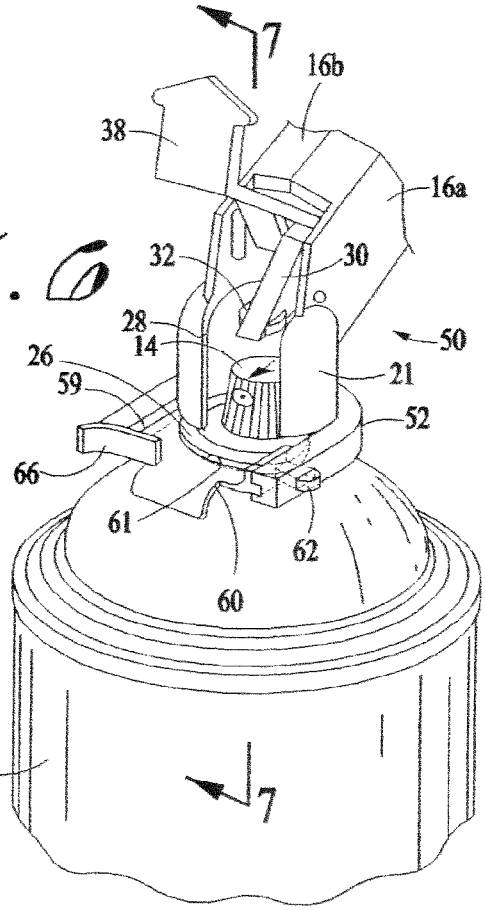
FIG. 6
FIG. 7
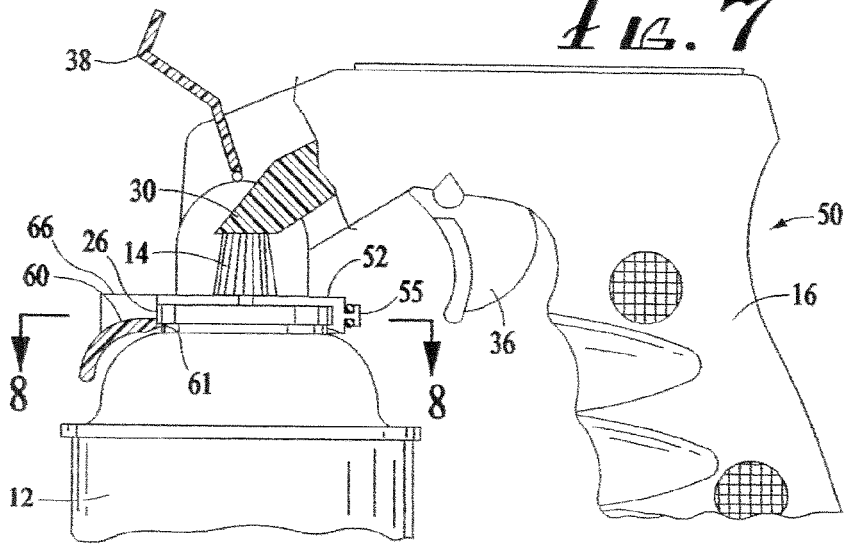

SPRAY CAN HOLDING AND ACTUATING DEVICE

CROSS REFERENCE TO RELATED APPLICATION

This application is a Divisional of application Ser. No. 11/273,523 filed Nov. 14, 2005 now U.S. Pat. No. 7,121,435, which is a divisional of application Ser. No. 10/154,545, filed May 24, 2002, now U.S. Pat. No. 6,981,622, issued Jan. 3, 2006. The disclosures of both of these related applications are expressly incorporated herein by reference.

FEDERALLY SPONSORED RESEARCH OR DEVELOPMENT

Not Applicable

BACKGROUND OF THE INVENTION

The present invention relates to a device for both holding a pressurized container, such as an aerosol spray can, and for actuating the valve of the container to dispense its pressurized contents. Specifically, the present invention relates to an improvement in the mechanism by means of which these devices are attachable to such containers.

Spray can holding and actuation devices are well known in the art, as exemplified by the following U.S. patents: U.S. Pat. No. 2,877,934—Wallace; U.S. Pat. No. 3,172,582—Belpedio; U.S. Pat. No. 3,189,232—Joffe, and U.S. Pat. No. 4,089,440—Lee. Further examples of such devices are disclosed in the following United Kingdom patent specifications: 1,163,978; 1,343,881; 1,487,719; 2,001,706 (published application); and 2,038,952 (published application).

One of the most popular types of spray can actuation devices has the general configuration of a pistol, as exemplified in the following U.S. patents: U.S. Pat. No. 4,432,474—Hutchinson et al.; U.S. Pat. No. 4,805,812—Brody; U.S. Pat. No. 5,086,954—Brody; U.S. Pat. No. 5,323,937—Brody; and U.S. Pat. No. 5,819,985—Brody. These devices typically include a body having a pistol grip handle, and means on the front of the body for removable attachment to the top of a spray can, the latter having a push-button spray valve. The body carries a valve actuation member that is operatively connected to a trigger, the latter being located with respect to the handle in a position analogous to that of a pistol trigger. The linkage between the trigger and the valve actuation member causes the actuation member to be brought into operable engagement with the valve when the trigger is squeezed, thereby actuating the valve to dispense the container's contents.

The devices disclosed in the above-referenced patents to Brody add to this structure a mechanism for disabling or locking the valve actuation mechanism. Further improvements, disclosed and claimed in U.S. Pat. Nos. 5,086,954; 5,323,937; and 5,819,985, relate to the structure of the device that provides for the attachment of the device to a spray can bey engagement with a rim or channel that typically surrounds the valve.

While many of the prior art devices, and particularly those disclosed in the aforementioned patents to Brody, have achieved commercial success, further improvements have been sought to increase the utility and improve the performance of the available spray can holding and actuation devices. Specifically, a mechanism has been sought for securing the device to a spray can that yields the advantages (e.g., excellent holding strength) that are obtained from the device of U.S. Pat. No. 5,819,985—Brody, but which can be manufactured more simply and economically. In addition, a mechanism of this nature should also, advantageously, be configured so as to offer a clear, unobstructed path for the spray emitted from the nozzle of the valve.

FIG. 1 illustrates one prior art approach to the problem of providing a secure attachment between a spray can holding and actuation device and the rim surrounding the spray can valve. This prior art spray can holding and actuation device 100 has a generally pistol-shaped body 102 with a downward and forward extending front portion 104 that is adapted for attachment to a typical spray can 106 having a push-button valve 108 surrounded by an annular rim 110. The front portion 104 of the device 100 is provided with a can retention member in the form of a split ring, comprising first and second ring halves 112*a*, 112*b* attached at the rear by a hinge (not shown). The free end of the first ring half 112*a* has a slot 116, and the free end of the second ring half 112*b* is provided with a finger or protuberance 118 that is received in the slot 116 to secure the ring halves 112*a*, 112*b* together when they are placed around the rim 110. To provide adequate stabilization of the can 106, the first ring half 112*a* is provided with a slotted tab 120 approximately 90° from end slot 116, and this slotted tab 120 receives a projection 122 that extends laterally from the front portion 104 of the body 102.

The above-described prior art device has proved somewhat complex and expensive to manufacture, and there remain some problems with the stability and security of the can attachment, especially with larger and heavier cans. This is due, at least in part, to the fact that while the ring halves 112*a*, 112*b* surround and engage the rim 110, they do not apply any significant inwardly-directed compressive force against the rim 110. Furthermore, some users find it cumbersome to line up the slotted tab 120 so that it receives the projection 122. Also, there may be a tendency of the protuberance 118 to break off in the attempt to insert it into the slot 116.

Thus, there is a need for a secure attachment mechanism for use with larger, heavier cans, and for an attachment mechanism that is easier to use and less prone to breakage. Furthermore, there is a need for an attachment mechanism that meets these criteria, while being simpler and more economical to manufacture than those that have heretofore been available. All of these criteria should advantageously be met with a mechanism that does not present any significant obstruction to the path of the spray emitted from the nozzle of the valve.

SUMMARY OF THE INVENTION

Broadly, the present invention is an improved aerosol spray can holding and actuation device of the type generally exemplified by U.S. Pat. Nos. 4,805,812; 5,086,954; 5,323,937; and 5,819,985, the disclosures of all of which are incorporated herein by reference. The improvement comprises a compressible rim engagement element and a locking mechanism for compressing the rim engagement element into a locking engagement against the rim surrounding the push-button valve on the can, thereby effecting a secure attachment between the rim engagement element and the rim. In a first embodiment, the locking mechanism comprises a snap-on locking element that is configured to engage a pair of protuberances on the rim engagement element so as to compress the rim engagement element radially inwardly, and thus maintain it in a secure locking engagement with the rim. In a second embodiment, and also a third embodiment, the locking mechanism comprises a locking latch that is pivotally attached to the rim engagement element, and that is selectively movable between an open position and a closed or locked position in which it compresses the rim engagement element and secures it in a locking engagement with the rim. In a fourth embodiment, the locking mechanism comprises a locking latch that is pivotably attached to the rear of the front portion of the body, and that includes an opposed pair of inwardly directed fingers, each of which rides in a groove in opposite sides of the front portion above the rim engagement element. Each groove includes a camming surface, located in the grooves so that when the latch is pivoted to bring the fingers into engagement with the camming surfaces, the rim engagement element is compressed radially inwardly into a locking engagement with the rim.

More specifically, the rim engagement element of the present invention comprises an opposed pair of collar segments that define a collar dimensioned to fit around the exterior periphery of the rim. The collar segments are integral with a shroud depending downwardly from the front portion of the device body, and they are joined together at the rear. The collar defined by the collar segments is open at the front, with a gap defined between two opposed ends.

In the first embodiment, a protuberance extends outwardly from each of the ends, and the locking element is in the form of a locking strip having a pull tab and a pair of spaced-apart apertures located and dimensioned to receive the protuberances when the collar ends are squeezed together to compress the collar segments radially inwardly, thereby to effect a firm, locking engagement between the collar and the rim. The strip is dimensioned to bridge the gap between the collar ends, and it snaps onto the collar ends when each of the protuberances on the collar ends is inserted into its respective slot or aperture in the strip. Thus, the locking strip, when snapped onto the collar ends, maintains the collar in its compressed configuration in which it is in a locking engagement with the rim. To remove the holding and actuation device, the pull tab is pulled so as to free the strip from the protuberance that is closer to the pull tab, leaving the strip attached to the collar by the engagement between the other protuberance and its associated aperture. Thus, the strip may remain attached to the collar for reattachment of the device to another can.

In the second embodiment, the collar segments are joined together, and preferably urged toward each other by a pivoting locking latch. The two collar segments are joined at the rear and form a substantially U-shaped collar, open at the front. The collar thus includes first and second substantially parallel linear portions extending forward from a curved rear portion that is dimensioned to fit around approximately the rear half of the rim, and that is advantageously grooved to receive and hold the rear half of the rim. The first collar segment includes a flexible, reduced-thickness portion near its free end, that includes a socket in the form of an aperture, and it also is advantageously formed with a groove that is contiguous with the groove of the rear portion, for receiving and holding an additional segment of the rim. The second collar segment is provided with a horizontal channel extending the length of its flexible linear portion, to approximately its juncture with the curved rear portion.

The locking latch has a curved interior surface defined between first and second ends. From the first end extends a pivot pin that fits into the socket in the first collar segment, whereby the latch is pivotally attached to the first collar segment by the pivot pin. The latch has a second end that is provided with a horizontal bead or tongue that is dimensioned to fit into the channel in the second collar segment. The latch is pivotable between an open or unlocked position and a closed or locked position. In the unlocked position, the second end of the latch is clear of the second collar segment. In the locked position, the tongue or bead on the second end of the latch is fully inserted into the channel in the second collar segment, thereby engaging the second collar segment. In this locked position, the inner surface of the latch engages against the rim, thereby forming a tight-fitting rim engagement structure in combination with the collar. Advantageously, the pivoting attachment of the latch to the first collar segment is accomplished so that when the latch is moved toward its locked position, the flexible portion of the first collar segment is resiliently urged toward the second collar segment to provide a tighter grip against the rim.

In the third embodiment, the rim engagement element comprises first and second collar segments that are joined together at the rear to form a substantially annular collar that is open at the front, with a gap defined between two opposed collar ends. A protuberance extends forward from one collar end, while a pivoting locking element is attached by an integral ("living") hinge to the other collar end. The locking element has an aperture dimensioned to receive the protuberance. When the locking element is pivoted to its closed position, the collar segments are urged together to compress the collar radially inwardly. The protuberance is received in the aperture of the locking element to secure the collar in its compressed configuration in secure engagement against the rim.

In the fourth embodiment, the shroud depending from the front portion of the body is modified as follows: A U-shaped latch is pivotably attached to rear of the shroud, with a pair of opposed arms that extend toward the front of the shroud. Each of the arms terminates in an inwardly-extending finger that is captured in an arcuate groove formed in the adjacent side of the shroud, above the collar. Each of the grooves is formed with a camming surface near its lower end. As the latch is pivoted downwardly, the fingers encounter the camming surfaces and urge the collar segments toward each other (i.e., radially inwardly), thereby compressing the collar into a firm and secure engagement against the rim.

As will be more fully appreciated from the detailed description below, all of the embodiments of the present invention provide secure attachment of the spray can holding and actuation device to a spray can, even if the can is quite heavy. Moreover, these embodiments can be simply and economically manufactured using conventional injection molding techniques, and thus can easily be incorporated into existing spray can holding and actuation devices.

BRIEF DESCRIPTION OF THE DRAWINGS

FIG. 1 is a perspective view of a spray can holding and actuating device incorporating a prior art can attachment mechanism, as described above, showing the device attached to a typical spray can;

FIG. 2 is a perspective view of a spray can holding and actuating device in accordance with a first embodiment of the present invention, showing the device attached to a typical spray can;

FIG. 6 is a perspective view of a spray can holding and actuating device in accordance with a second embodiment of the present invention, showing the device attached to a typical spray can;

FIG. 7 is a left side elevational view of the device of FIG. 6, with a portion shown in a cross-section taken along line 7-7 of FIG. 6;

FIG. 8 is a cross-sectional view taken along line 8-8 of FIG. 7;

DETAILED DESCRIPTION OF THE PREFERRED EMBODIMENTS

Figure 3:
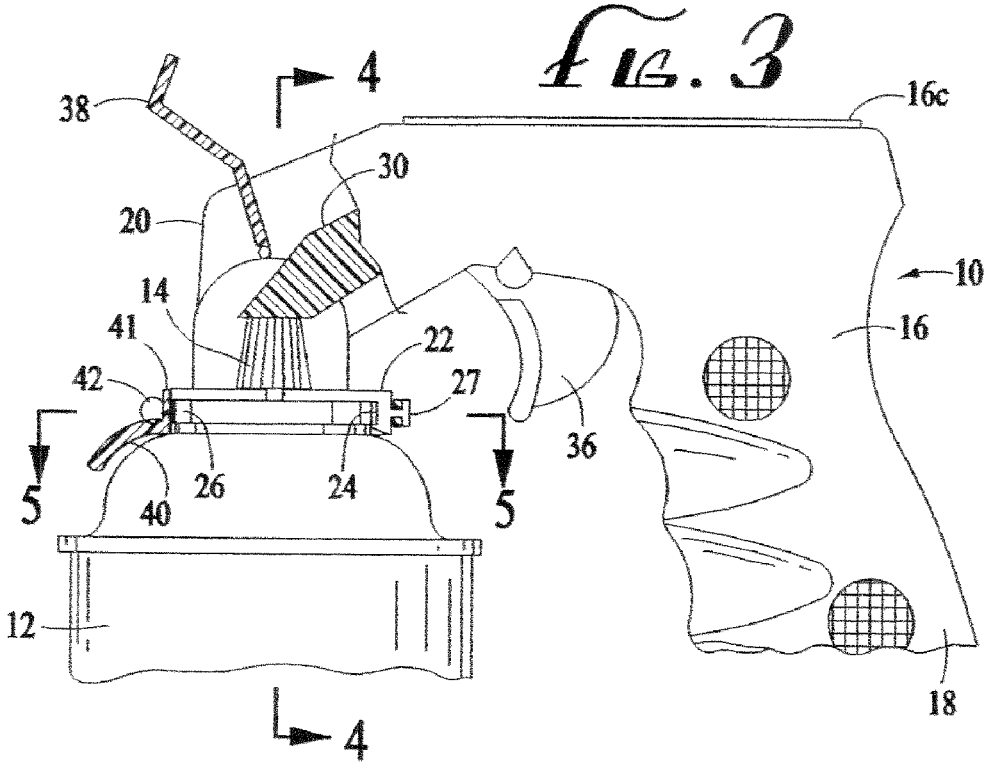
FIG. 3 is a left side elevational view of the device of FIG. 2, with a portion shown in a cross-section taken along line 3-3 of FIG. 2.
Figure 4:
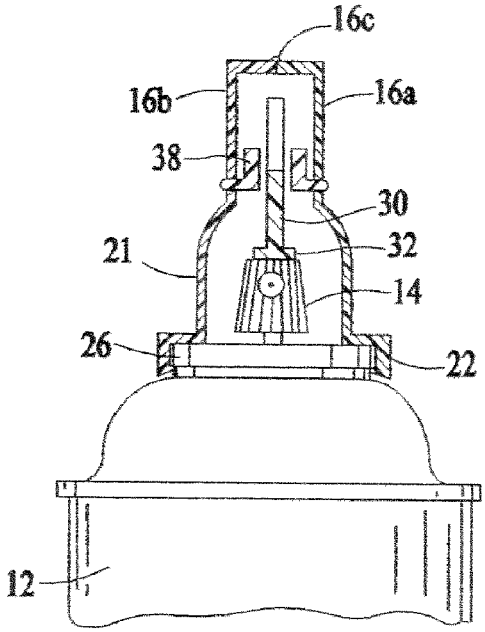
FIG. 4 is a front elevational view with a portion shown in a cross-section taken along line 4-4 of FIG. 3.

Referring now to the drawings, FIGS. 2 through 5 show an improved actuation and holding device 10, in accordance with a first preferred embodiment of the present invention, attached to a pressurized container or can 12, having a push-button spray valve 14. The actuation and holding device 10 has a body 16 that would typically be made of molded plastic by conventional techniques, well-known in the art, such as the "butterfly" injection molding method. The body 16 includes a pistol grip handle 18 and a forward or front portion 20 that extends in a generally downward direction, terminating in a downwardly-depending shroud 21 that is joined to a rim engagement element in the form of a generally annular collar 22, interrupted in the front by a gap. The shroud 21 is open at the front, to allow the dispensing of the can's contents from the nozzle of the valve 14. The opening of the shroud 21 is approximately the same width as the front gap in the collar 22.

The collar 22 includes a horizontal internal slot or groove 24 that is dimensioned to receive an annular rim 26 formed in the top of the container 12, around the push-button valve 14. The collar 22 is internally dimensioned so that, in its normal, relaxed or uncompressed configuration, it fits loosely around the exterior periphery of the rim 26. As described below, the collar 22 may be resiliently deformed into a compressed configuration, in which the free ends of the collar 22 are resiliently urged toward each other in the gap.

Figure 5:
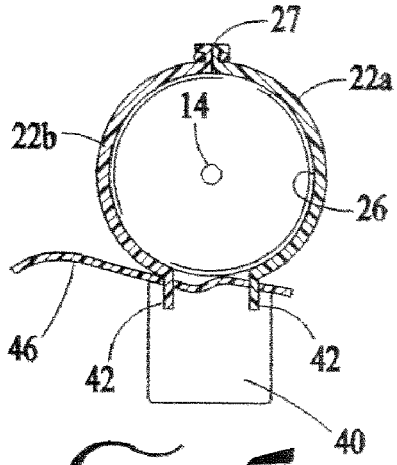
FIG. 5 is a cross-sectional view taken along line 5-5 of FIG. 3.

In the preferred embodiments of the present invention, the body 16 of the device 10 is formed by the above-mentioned "butterfly" molding method. Thus, the body 16 is initially formed in two axial or longitudinal halves 16*a* and 16*b*, joined along a longitudinal integral hinge 16*c*, along which the body halves 16*a*, 16*b* are folded together. The shroud 21 is therefore also longitudinally divided into two shroud halves, as is the collar 22, which is thus correspondingly divided into two collar segments 22*a*, 22*b* (FIG. 5) that are respectively integral with the body halves 16*a*, 16*b*, each of the collar segments 22*a*, 22*b* thereby being integral with one of the shroud halves. The collar segments 22*a*, 22*b* are joined together at a rear juncture 27, diametrically opposite the frontal gap, as best shown in FIG. 5, and may be pinned or otherwise secured together by means well-known in the art. Other types of manufacturing or molding techniques might allow for the collar 22 to be unitary. The body halves 16*a*, 16*b* are attached to one another by some conventional attachment mechanism, such as one or more pin and socket arrangements (not shown), in the pistol grip handle 18. Other than the juncture 27, there is no such attachment between the body halves 16*a*, 16*b* in the front portion 20 or the shroud 21.

As mentioned above, the shroud 21 has an opening 28 in the front, defined on the sides and top by the wall surfaces of the shroud 21. The contents of the container 12 are dispensed from the nozzle of the valve 14 through the opening 28. The device 10 includes a valve actuation member comprising a lever 30 disposed longitudinally within the body 16. The lever 30 has a first or free end which extends through the forward portion 20 of the body 16 and into the opening 28, thereby being disposed just above the valve 14. The free end terminates in a laterally-extended surface in the form of a flattened disk 32 that provides a flat, substantially circular surface for effecting a positive engagement with the valve 14, as described below. The other end of the lever 30 extends through an opening in the underside of the body 16 and is configured in the shape of a trigger 36. The actuation lever 30 pivots on a pin (not shown) when the trigger 36 is pressed toward the handle 18, thereby causing the free end to pivot downwardly to bring the disk 32 into operative engagement against valve 14. In this manner, the valve 14 is depressed to dispense the contents of the container 12. The actuation lever 30 may include a resilient, rearwardly-extending extension (not shown) that engages an interior surface of the body 16, and that acts as a spring to assist the return of the lever 30 to its original position when the trigger 36 is released. In this original position, the free end of the lever 30 is out of engagement with the valve 14, as shown in FIG. 1.

The device 10 may advantageously be provided with a locking plate 38 that is pivotably attached to the front of the body 16, as disclosed and claimed in U.S. Pat. No. 4,805,812—Brody, and as further disclosed in U.S. Pat. No. 5,819,985—Brody, the disclosures of which are incorporated herein by reference. The locking plate 38 is movable between an unlocking raised position (shown in the drawings), in which the actuation lever 30 has an unobstructed path for engagement with the valve 14, and a locking lowered position (not shown), in which it locks the actuation lever 30 in a position that is disengaged from the valve 14.

As shown in FIGS. 2 through 5, a locking element, in accordance with a first preferred embodiment of the present invention, comprises a locking strip 40 that snaps onto and mates with the collar 22. The collar 22 includes a pair of protuberances 42, one of which extends outwardly from each of the opposed free ends of the collar 22. The locking strip 40 is formed as a substantially planar flap with a pair of spaced-apart posts 41 at each end, each of which has an aperture or slot 44. The slots 44 are located and dimensioned to receive the protuberances 42 when the collar ends are urged together to compress the collar 22 radially inwardly into its compressed configuration, around and against the rim 26, thereby effecting a firm, locking engagement between the collar 22 and the rim 26. The strip 40 is dimensioned to bridge the gap between the collar ends, and it snaps onto the collar ends when each of the protuberances 42 on the collar ends is inserted into its respective slot or aperture 44 in the strip 40. Thus, the locking strip 40, when snapped onto the collar ends, maintains the collar 22 in its compressed configuration, and thus in a locking engagement with the rim 26. The flat or planar configuration of the strip 40 between the posts 41 provides an unobstructed path for the spray emitted from the nozzle of the valve 14 when the valve 14 is actuated.

One of the posts 41 of the locking strip 40 is provided with an integral horizontal or lateral extension 46 that serves as a pull tab. To unlock the collar 22 from the rim 26, the pull tab 46 is pulled away from the rim 26 so as to free the strip 40 from the protuberance 42 that is closer to the pull tab 46 (the proximal protuberance), leaving the strip 40 attached to the collar 22 by means of the engagement between the other (distal) protuberance 42 and its associated aperture 44, thereby leaving the strip 40 attached to the collar 22 by means of the distal protuberance 42 for convenient re-attachment of the device 10 to another can.

When the locking strip 40 is removed from the collar 22, the collar ends resiliently return to their original positions, thereby restoring the collar 22 to its relaxed or uncompressed configuration, in which it is easily disengaged from the rim 26.

The ability of the collar segments 22*a*, 22*b* to be selectively clamped against the rim 26 and released from it is largely provided by the lack of any mechanical connection between the body halves 16*a*, 16*b* at the front portion 20 of the body 16 (other than the juncture 27 at the rear of the collar). These two features allow the collar segments 22*a*, 22*b* to separate sufficiently from each other to allow them to be easily located around the rim 26 and to be easily removed therefrom when the locking strip 40 is unfastened from the proximal protuberance 42 (as described above), and to be pressed more closely together by the compressive force applied by the locking strip 40 when it is secured to the proximal protuberance 42. This compressive closing action thus gives the device 10 a very secure grip on the rim 26, while allowing a quick release when the compressive force is removed by unfastening the locking strip 40 from the proximal protuberance 42.

FIGS. 6-8 illustrate an improved actuation and holding device 50, in accordance with a second preferred embodiment of the invention. The device 50 is shown attached to a spray can 12, which is in all material respects identical to that described above. The device 50, likewise, is similar to the device 10 of the first preferred embodiment described above, except for the rim engagement element and the locking mechanism. The following description will accordingly be limited to the rim engagement element and the locking mechanism.

The device 50, in accordance with the second embodiment of the invention, includes a rim engagement element in the form of a U-shaped collar 52, which is open at the front. If the device 50 is made by the butterfly molding process or the like, the collar 52 comprises first and second collar segments 54*a*, 54*b* that are respectively integral with the body halves 16*a*, 16*b*, as described above with respect to the collar segments 22*a*, 22*b* of the first embodiment. The first and second collar segments 54*a*, 54*b* are pinned or otherwise joined together at a rear juncture 55 diametrically opposed to the front opening. Alternatively, the device 50 may be made by other methods that may allow the collar 52 to be formed as a unitary U-shaped element.

The first and second collar segments 54*a*, 54*b* include flexible, substantially linear portions that respectively define first and second substantially parallel legs, and curved portions that join together at the juncture 55 to form a curved rear portion 54*c* that is dimensioned to fit around the rear of the rim 26. A horizontal slot or groove 56 may advantageously be formed in the curved rear portion 54*c*, extending into a part of the linear portion of the first collar segment 54*a*. The slot or groove 56 is dimensioned to receive the rim 26. The linear portion of the first collar segment 54*a* includes a flexible, reduced thickness part 57 near its front end. An aperture or socket 58 is provided in the reduced thickness part 57, while the second collar segment 54*b* is provided with a horizontal channel 59 in its linear portion, extending from its forward end to approximately its juncture with the curved rear portion 54*c*.

The locking mechanism comprises a pivoting locking latch 60. The locking latch 60 includes a substantially flat, planar body with a curved interior surface 61 defined between first and second ends. The interior surface 61 has a radius of curvature that conforms closely to that of the rim 26 of the can 12. The first end is turned upright, substantially perpendicular to the body, and it is formed with a laterally-extending pivot pin 62 that fits into the aperture or socket 58 in the first collar segment 54*a*, whereby the latch 60 is pivotally attached to the first collar segment 54*a* by the pivot pin 62. The latch 60 has a second end that is provided with a horizontal bead or tongue 64 that is dimensioned to fit into the channel 59 in the second collar segment 54*b*. A pull tab 66 may advantageously extend from the second end of the latch 60.

The latch 60 is pivotable between an open or unlocked position and a closed or locked position. In the unlocked position (shown in solid outline in FIG. 8), the second end of the latch is clear of the second collar segment 54*b*. In the locked position (shown in FIG. 6 and in phantom outline in FIG. 8), the tongue or bead 64 on the second end of the latch 60 is fully inserted into the channel 59 in the second collar segment 54*b*, and is frictionally engaged therein, whereby the latch 60 becomes securely engaged with the second collar segment 54*b*. In this locked position, the curved inner surface 61 of the latch 60 is brought to bear against the front portion of the rim 26, thereby forming a tight-fitting rim engagement structure in combination with the collar 52. In addition, the attachment of the pivot pin 62 in the socket 58 is such that the movement of the latch 60 toward its locked position advantageously urges the flexible portion 57 of the first collar segment 54*a* toward the linear portion of the second collar segment 54*b*, thereby compressing the collar and thus providing a tighter engagement of the collar 52 against the rim 26. As in the first embodiment described above, the substantially horizontal or flat configuration of the body of the latch 60 provides an unobstructed passage for the spray emitted from the nozzle of the valve 14.

Figure 9:
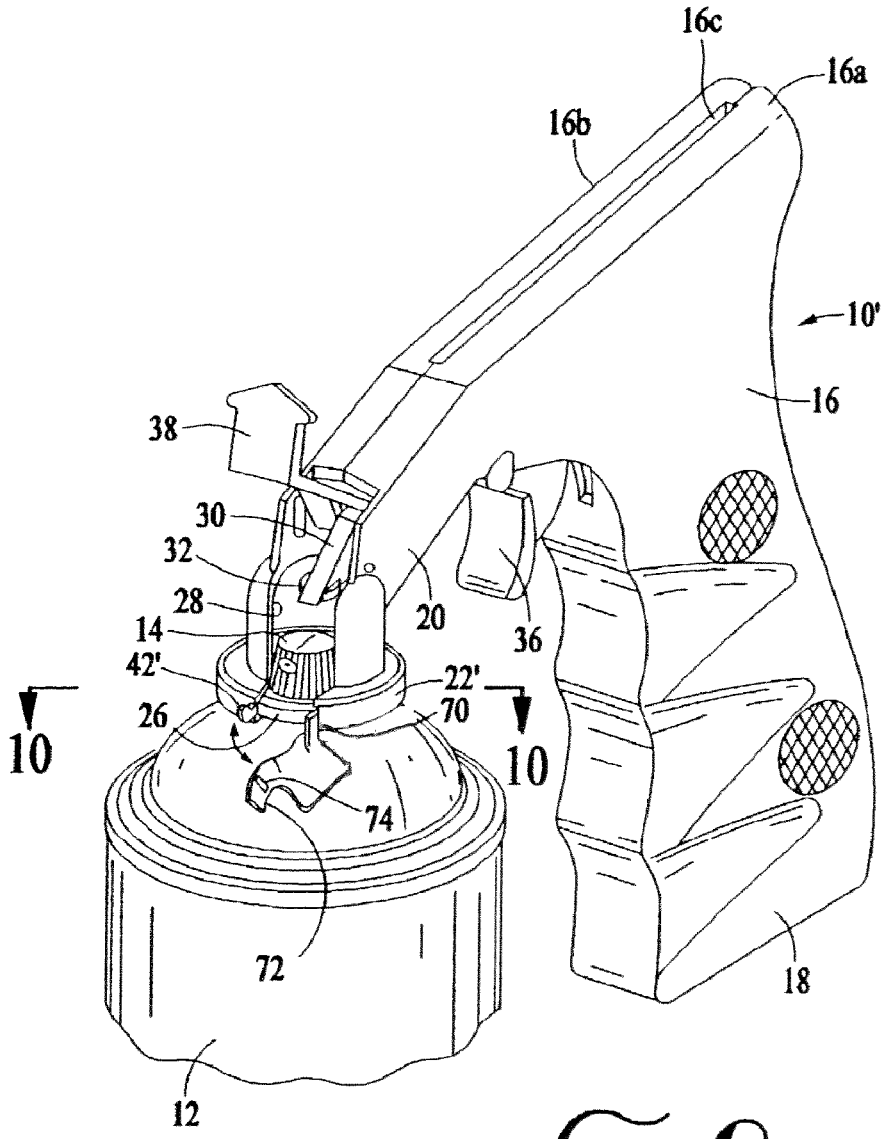
FIG. 9 is a perspective view of a spray can holding and actuating device in accordance with a third embodiment of the present invention, showing the device attached to a typical spray can.
Figure 10:
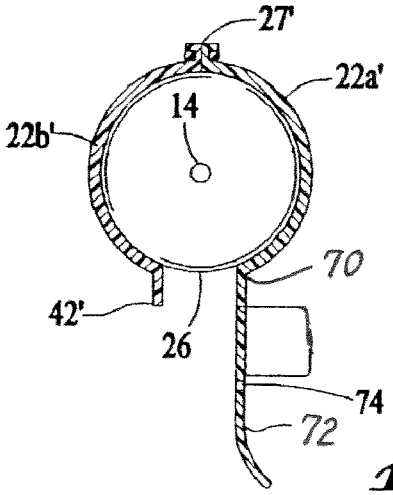
FIG. 10 is a cross-sectional view taken along line 10-10 of FIG. 9.

FIGS. 9 and 10 illustrate a can holding and actuation device 10' in accordance with a third preferred embodiment of the invention. In this embodiment, as in the above-described first embodiment, a substantially annular collar 22' is formed by two collar segments 22*a*' and 22*b*' joined at a rear juncture 27'. The collar 22' is open at the front, with two opposed ends separated by a gap. The collar 22' is thus similar to the collar 22 of the above-described first embodiment, except that it has only a single protuberance 42' extending forward from one end, adjacent the frontal gap. Attached to the other collar end by an integral or living hinge 70 is a locking latch 72. Because of the living hinge attachment, the locking latch 72 differs from the locking strip 40 of the above-described first embodiment primarily in that it is provided with only a single aperture 74 that is located and dimensioned to receive the protuberance 42' when the latch 72 is pivoted on the hinge 70 toward a closed position (not shown). When the latch 72 is secured by the engagement of the protuberance 42' in the aperture 74, the collar segments 22*a*', 22*b*' are urged together to compress the collar 22' into a secure engagement with the rim 26.

Figure 13:
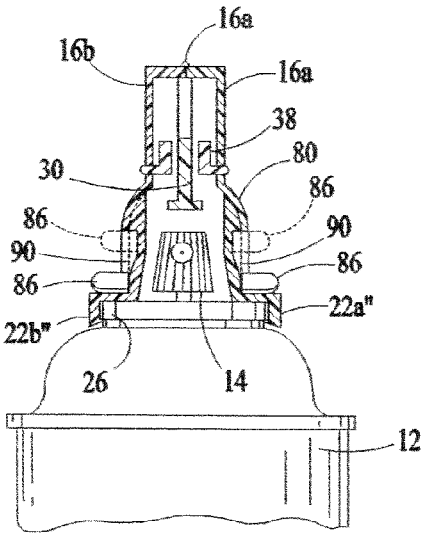
FIG. 13 is a front elevational view with a portion shown in a cross-section taken along line 13-13 of FIG. 12.
Figure 11:
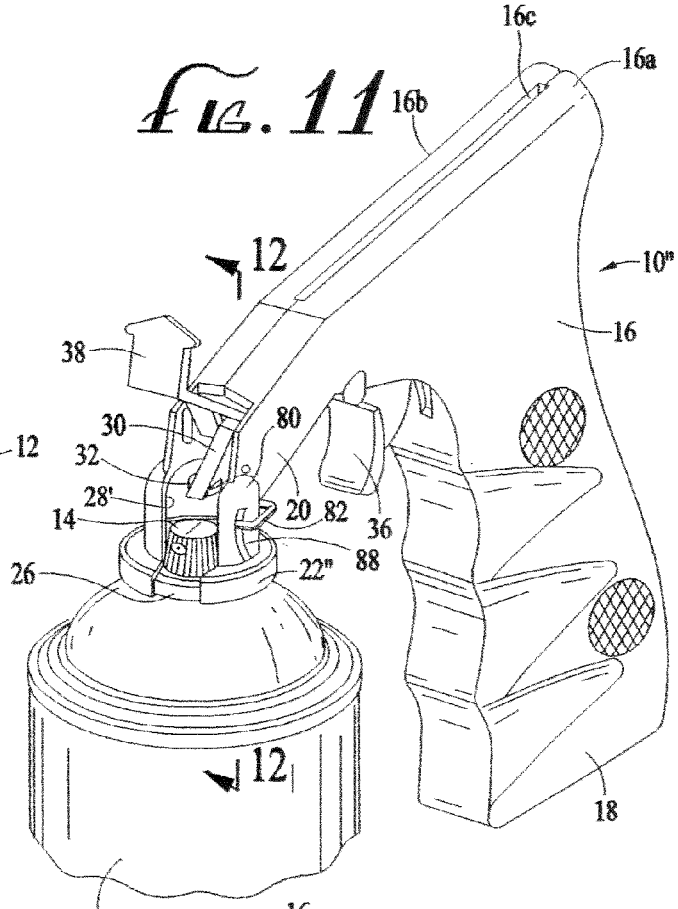
FIG. 11 is a perspective view of a spray can holding and actuating device in accordance with a fourth embodiment of the present invention, showing the device attached to a typical spray can.
Figure 12:
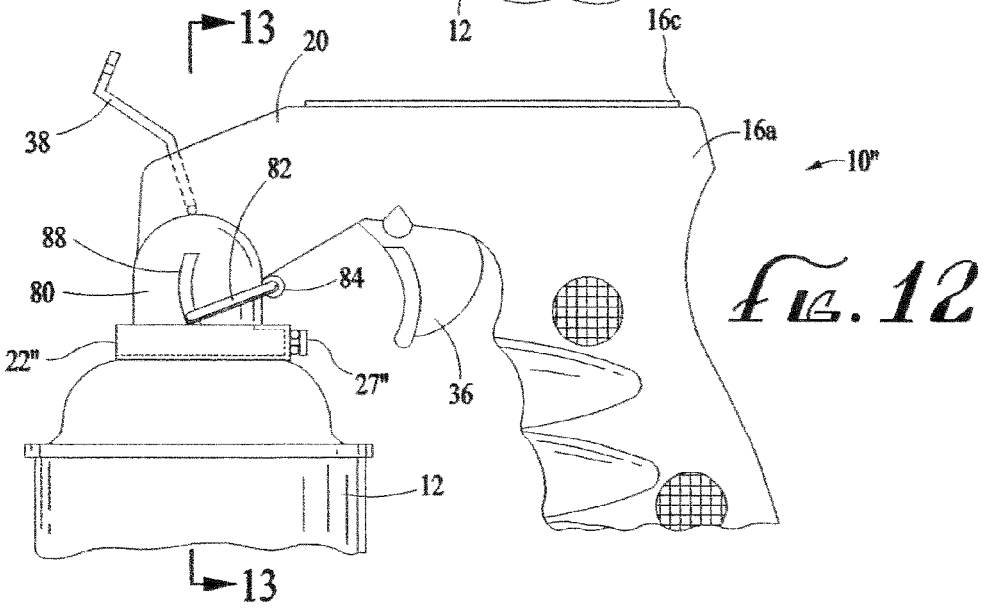
FIG. 12 is a left side elevational view taken along line 12-12 of FIG. 11.

A can holding and actuation device 10" in accordance with a fourth embodiment is illustrated in FIGS. 11-13. In this embodiment, a substantially annular collar 22" is formed by two collar segments 22*a*" and 22*b*" joined at a rear juncture 27". The collar 22" is open at the front, with two opposed ends separated by a gap. The device 10" has a front portion 20" that terminates in a shroud 80 that has an opening 28' at the front to permit the dispensing of the can's contents from the nozzle in the pushbutton 14. The opening 28' of the shroud 80 is approximately equal in width to the gap at the front of the collar 22". The shroud 80, like the body of the device 10" of which it is an integral part, is bifurcated so that each of its halves is integral with one of the body halves 16*a,* 16*b,* and is joined at its bottom end to the collar 22". Thus, one shroud half is integral with the first collar segment 22*a*", and the other shroud half is integral with the second collar segment 22*b*".

A U-shaped latch 82 is pivotably attached to the rear of the shroud 80, preferably by means of a pair of aligned apertures or journals 84 (only one of which is shown in FIG. 12). The latch 82 has a pair of opposed arms that extend forward, along the sides of the shroud 80, toward the front of the shroud 80. Each of the arms terminates in an inwardly-extending finger 86 that is captured in an arcuate groove 88 formed in the adjacent side of the shroud, above the collar 22". Each of the grooves 88 is formed with a camming surface 90 near its lower end.

The latch 82 is pivotable between an upper or unlocked position, shown in phantom outline in FIG. 13, and a lower or locked position, shown in solid outline in FIG. 13. As the latch 82 is pivoted downwardly from the upper position to the lower position, the fingers 86 encounter the camming surfaces 90 and urge the collar segments 22*a*", 22*b*" toward each other (i.e., radially inwardly), thereby compressing the collar 22" into a firm and secure engagement against the rim.

From the foregoing description, it can be seen that the several embodiments of the present invention offer a distinct advantage over the current state of the art, in that a spray can actuation and holding device is provided that is both simple and economical to manufacture, and that also affords a very secure attachment of the actuation and holding device to the container or can 12. Furthermore, the attachment is sufficiently secure to allow the device to be used confidently even with large and heavy cans. This enhanced security of attachment is achieved in a manner entirely consistent with conventional injection molding techniques, without adding significantly to the cost of manufacturing the current types of can holding and actuation devices.

Although several preferred embodiments have been described herein, variations and modifications of these embodiments will suggest themselves to those skilled in the pertinent arts. Thus, the specific configurations of the collars and the locking elements disclosed herein are exemplary only. In the present invention, attachment of the holding device to the can is enhanced by the compressive closing action of the two collar segments provided by the lack of attachment between the body halves 16*a,* 16*b* at the forward portion 20 of the body 16, as explained above. This principle can be broadly realized by the use of a rim engagement element or collar that circumscribes a substantial portion of the rim, and a locking element that selectively compresses the collar into a secure engagement with the rim. It will therefore be appreciated that the same operational principle can be realized with a wide variety of configurations for these components, other than those specifically described herein. Such variations should be considered within the spirit and scope of the present invention, as defined in the claims that follow.

What is claimed is:

1. A device for holding a pressurized container and actuating a push-button valve in the top of the container to dispense the contents thereof, the container having an annular rim around the valve, the rim having an exterior periphery, the device having a front portion and an actuation member in the front portion that is engageable with the valve for the actuation thereof, wherein the improvement comprises:

a collar on the front portion that is dimensioned to fit partially around the exterior periphery of the rim and that is resiliently compressible into a locking engagement against the exterior periphery of the rim, the collar comprising a pair of collar segments, each having a first end and a second end, the first ends being joined to each other at a rear juncture, the second ends being separated by a gap when the collar is placed around the rim, wherein the second ends are movable toward each other to a compressed configuration in which the collar is compressed against the exterior periphery of the rim, a first one of the second ends having a protuberance extending outwardly therefrom; and a locking latch attached to the second one of the free ends and having an aperture dimensioned and located so as to receive the protuberance when the second ends are moved toward each other so as to maintain the collar in the compressed configuration.

2. The device of claim 1, wherein the locking latch is attached to the second one of the free ends by an integral hinge.

* * * * *